US009140452B2

(12) United States Patent
Reiss et al.

(10) Patent No.: US 9,140,452 B2
(45) Date of Patent: Sep. 22, 2015

(54) COMBUSTOR HEAD PLATE ASSEMBLY WITH IMPINGEMENT

(75) Inventors: Frank Reiss, Lauchringen (DE); Jaman El Masalme, Hamminkeln (DE)

(73) Assignee: MAN Diesel & Turbo SE, Augsburg (DE)

( * ) Notice: Subject to any disclaimer, the term of this patent is extended or adjusted under 35 U.S.C. 154(b) by 1205 days.

(21) Appl. No.: 12/913,295

(22) Filed: Oct. 27, 2010

(65) Prior Publication Data

US 2011/0265483 A1 Nov. 3, 2011

(30) Foreign Application Priority Data

Oct. 28, 2009 (DE) ..... 10 2009 046 066

(51) Int. Cl.
*F23R 3/04* (2006.01)
*F23R 3/26* (2006.01)
*F23R 3/14* (2006.01)
(Continued)

(52) U.S. Cl.
CPC ... *F23R 3/14* (2013.01); *F23R 3/04* (2013.01); *F23R 3/286* (2013.01); *F23R 3/26* (2013.01); *F23R 3/42* (2013.01); *F23R 2900/03041* (2013.01); *F23R 2900/03044* (2013.01); *F23R 2900/03045* (2013.01)

(58) Field of Classification Search
CPC .... F23R 3/42; F23R 3/04; F23R 2900/03041; F23R 2900/03042; F23R 2900/03044
USPC ..... 60/756, 752, 754, 755
See application file for complete search history.

(56) References Cited

U.S. PATENT DOCUMENTS 3,751,911 A * 8/1973 De Tartaglia ..... 60/756
4,008,568 A * 2/1977 Spears et al. ..... 60/796
4,561,257 A * 12/1985 Kwan et al. ..... 60/737
(Continued)

FOREIGN PATENT DOCUMENTS

DE 43 28 294 3/1995
DE 692 10 118 12/1996
(Continued)

OTHER PUBLICATIONS

Joos, et al., "Development of the Sequential Burn System for the Gas Turbine Family GT24/GT26",ABB Technik [ABB Review], Apr. 1988, pp. 4-16 (Computer translation of Abstract).
(Continued)

*Primary Examiner* — Phutthiwat Wongwian
*Assistant Examiner* — Rene Ford
(74) *Attorney, Agent, or Firm* — Cozen O'Connor

(57) ABSTRACT

Combustor for a turbine having a housing in which an air collecting chamber, a combustion antechamber, and a combustion chamber are formed. A combustor head plate is arranged in the housing so that the combustor head plate separates the combustion antechamber from the combustion chamber. A baffle plate is arranged in the combustion antechamber so that the baffle plate divides the combustion antechamber into a first sub-chamber adjoining an air supply fluidically connected with the air collecting chamber and a second sub-chamber adjoining the combustor head plate. Wherein baffle plate has a plurality of through-passages that fluidically connect the first sub-chamber with the second sub-chamber so that air that has flowed into the first sub-chamber from the air collecting chamber via the air supply can flow into the second sub-chamber via the through-passages and to a back surface of the combustor head plate facing the second sub-chamber.

9 Claims, 2 Drawing Sheets

(51) Int. Cl.

| | |
|---|---|
| ***F23R 3/28*** | (2006.01) |
| *F23R 3/42* | (2006.01) |

(56) References Cited

U.S. PATENT DOCUMENTS

| | | | | |
|---|---|---|---|---|
| 4,726,182 | A | 2/1988 | Barbier et al. | |
| 4,843,825 | A * | 7/1989 | Clark | 60/756 |
| 4,864,827 | A * | 9/1989 | Richardson et al. | 60/756 |
| 4,916,905 | A * | 4/1990 | Havercroft et al. | 60/756 |
| 5,012,645 | A * | 5/1991 | Reynolds | 60/754 |
| 5,329,761 | A * | 7/1994 | Ablett et al. | 60/804 |
| 5,490,389 | A * | 2/1996 | Harrison et al. | 60/737 |
| 5,509,270 | A * | 4/1996 | Pearce et al. | 60/740 |
| 5,581,994 | A * | 12/1996 | Reiss et al. | 60/782 |
| 5,605,046 | A * | 2/1997 | Liang | 60/752 |
| 5,623,827 | A * | 4/1997 | Monty | 60/748 |
| 5,839,283 | A | 11/1998 | Döbbeling | |
| 5,941,076 | A * | 8/1999 | Sandelis | 60/752 |
| 5,956,955 | A | 9/1999 | Schmid | |
| 6,495,207 | B1 * | 12/2002 | Prociw et al. | 427/245 |
| 6,546,733 | B2 | 4/2003 | North et al. | |
| 6,679,063 | B2 * | 1/2004 | Ebel | 60/798 |
| 6,749,396 | B2 * | 6/2004 | Barry et al. | 415/115 |
| 6,792,757 | B2 | 9/2004 | Borns et al. | |
| 6,871,501 | B2 * | 3/2005 | Bibler et al. | 60/772 |
| 7,631,503 | B2 * | 12/2009 | Stastny et al. | 60/756 |
| 7,730,725 | B2 * | 6/2010 | Faulder et al. | 60/752 |
| 2004/0083734 | A1 * | 5/2004 | Kendall et al. | 60/752 |
| 2009/0199563 | A1 * | 8/2009 | Chen | 60/740 |
| 2010/0077764 | A1 * | 4/2010 | Dierberger | 60/754 |

FOREIGN PATENT DOCUMENTS

| | | |
|---|---|---|
| DE | 195 42 521 | 5/1997 |
| DE | 195 49 143 | 7/1997 |
| DE | 10 2006 048 842 | 4/2008 |
| EP | 0 182 687 | 5/1986 |
| JP | 01-117941 | 5/1989 |
| JP | 05-187636 | 7/1993 |
| JP | 10-185193 | 7/1998 |
| WO | WO 96/04510 | 2/1996 |

OTHER PUBLICATIONS

Joos, et al., "Field Experience with the Sequential Combustion System of the GT24/GT26 gas Turbine Family", ABB Review, May 1998, pp. 12-20.

* cited by examiner

COMBUSTOR HEAD PLATE ASSEMBLY WITH IMPINGEMENT

BACKGROUND OF THE INVENTION

1. Field of the Invention

The invention is directed to a combustor for a turbine and to a gas turbine outfitted with a combustor.

2. Description of the Related Art

Various combustors are known for atmospheric combustion and combustion under pressure. Various combustors of this kind are also used in the field of gas turbines.

Examples of combustors for gas turbines are described in DE 10 2006 048 842 A1, DE 195 42 521 A1, DE 43 28 294 A1, DE 195 49 143 A1, WO 96/04510 and in the periodical "ABB Technik [ABB Review]", 4/1988, pages 4 to 16.

A chief objective in combustors is to allow the combustion to take place as completely as possible in a stable, controlled manner with low emissions in a large operating range. In certain combustors, special components are used as flame holders for stabilizing the combustion zone (heat releasing zones). Other combustors are designed in such a way that the stabilization is carried out in the area near the wall, e.g., in the center of the combustor. These components undergo high thermal loading, have a short lifetime and must therefore be exchanged often.

In order not to impair the stability of the combustion and so as not to remove any cooling air from the process, these component parts are not cooled in prior art. Therefore, inspection intervals and maintenance intervals for these components are correspondingly short, which leads to high extra costs in conjunction with the downtimes of the respective installations.

SUMMARY OF THE INVENTION

An object of the invention is to provide a combustor for a turbine, particularly for a gas turbine, in which the central component part, or flame holder, can be cooled efficiently without disrupting the combustion process in the combustor. The invention has the further object of providing a gas turbine which is outfitted with a combustor of this kind.

According to a first embodiment of the invention, a combustor is provided for a turbine, particularly a gas turbine, wherein the combustor has a housing in which an air collecting chamber, a combustion antechamber, and a combustion chamber are formed, a combustor head plate which is arranged in the housing so that the combustor head plate separates the combustion antechamber from the combustion chamber, a baffle plate which is arranged in the combustion antechamber so that the baffle plate divides the combustion antechamber into a first sub-chamber adjoining an air supply which is fluidically connected with the air collecting chamber and a second sub-chamber adjoining the combustor head plate, wherein the baffle plate has a plurality of through-passages which fluidically connect the first sub-chamber with the second sub-chamber so that air which has flowed into the first sub-chamber from the air collecting chamber via the air supply can flow into the second sub-chamber via the through-passages and can flow to a back surface of the combustor head plate facing the second sub-chamber.

The combustor head plate can be efficiently cooled and its thermal wear can accordingly be reduced with the solution according to the invention in that the back surface of the combustor head plate is acted upon by cooling air so that an efficient rebound cooling is achieved for the combustor head plate. Therefore, the cooling proposed by the invention appreciably prolongs the life of the combustor head plate. Since only the rear side of the combustor head plate is acted upon by the cooling air, which is preferably supplied to the combustion chamber at an outer edge of the combustor head plate, the air and cooling do not exert a disruptive influence on the combustion process in the combustor.

According to an embodiment form of the combustor according to the invention, the baffle plate extends parallel to the combustor head plate so that air that has flowed into the second sub-chamber impinges perpendicularly on the back surface of the combustor head plate.

According to another embodiment form of the combustor according to the invention, a gap is provided at the outer circumference of the combustor head plate, the second sub-chamber being fluidically connected to the combustion chamber by this gap, so that air rebounding from the back surface of the combustor head plate can flow into the combustion chamber via the gap.

Accordingly, the cooling air can be conveyed into the combustion chamber through the gap externally at the edge of the combustor head plate and consequently without disturbing the combustion process so that the air is retained in the overall process (combustor, turbine).

According to one embodiment of the invention, the injection of the cooling air should be carried out as externally as possible, away from the recirculating flow of the combustor, which ensures that a core zone of the recirculating flow is not disturbed.

According to one embodiment of the combustor, the second sub-chamber is defined at the outer circumference by an insertion part, wherein an opening which extends perpendicular to the through-passages and which fluidically connects the second sub-chamber with the gap is provided in a wall of the insertion part so that air rebounding from the back surface of the combustor head plate can flow into the gap through the opening.

On the one hand, the cooling air can be directed transversely to the outer edge of the combustor head plate and combustion chamber as needed via this opening so that its influence on the combustion is minimized; on the other hand, the air flow can be deliberately influenced by its diameter.

According to one embodiment form of the combustor according to the invention, the gap is formed as an annular gap, and a plurality of openings which extend perpendicular to the through-passages so as to be distributed along a circumference of the gap are provided in the wall of the insertion part and fluidically connect the second sub-chamber with the gap so that air rebounding from the back surface of the combustor head plate can flow into the gap via the openings.

By constructing the gap as an annular gap and by providing the plurality of openings which are uniformly distributed along its circumference, the air can be distributed extremely uniformly in the combustion chamber after the cooling of the combustor head plate so that its influence on the combustion is further minimized.

According to another embodiment form of the combustor according to the invention, the gap extends parallel to the through-passages so that a flow direction of the air through the gap is parallel to a flow direction of the air through the through-passages.

According to another embodiment form of the combustor according to the invention, a width of the gap is dimensioned in such a way that a flow rate of the air exiting from the gap is less than a flow rate of the air entering the gap.

In other words, the width of the gap is selected so as to be large enough that the flow rate of the air and, therefore, its depth of penetration into a main flow of the combustion are minimized which in turn ensures that the main flow is influenced as little as possible.

According to one embodiment form of the combustor according to the invention, a plurality of through-openings which fluidically connect the second sub-chamber to the combustion chamber are provided in the combustor head plate.

This presents another possibility for guiding the air flow so as to avoid influencing the combustion as far as possible, preferably at the outer edge of the combustor head plate or combustion chamber and while making further use of the air flow for the general process after cooling is carried out.

According to one embodiment form of the combustor according to the invention, the through-openings each have a diameter in the range of 0.3 mm to 1.5 mm so that the through-openings cause air that has flowed into the second sub-chamber via the through-passages to be effused into the combustion chamber through the combustor head plate.

This construction of the invention advantageously reinforces the cooling efficiency and assists in preventing any influence of the cooling air flow.

According to one embodiment form of the combustor according to the invention, the combustor head plate is formed by a porous material so that air that has flowed into the second sub-chamber can flow into the combustion chamber through pores in the combustor head plate.

This embodiment of the invention also provides an advantageous possibility for guiding the cooling air flow so as not to influence combustion as far as possible and while making further use of the air flow for the general process after cooling is carried out.

According to one embodiment form of the combustor according to the invention, an air guiding passage is provided in the second sub-chamber, and air rebounding from the back surface of the combustor head plate can be fed in via this air guiding passage downstream of the combustor head plate with reference to a combustion process in the combustion chamber.

In other words, an external cooling is used in this case, and the removal of the cooling air is carried out as described in connection with the other embodiment forms of the invention or is carried out at another location, e.g., between a compressor outlet and the air collecting chamber. After cooling is carried out, the air is not injected directly into the combustion chamber but rather is diverted, i.e., the air is not guided in immediately following the swirl body but at a subsequent position—downstream considered in the flow direction of the hot combustion gas. Possible positions for introducing the air extend from the area of a secondary zone of the combustion chamber to an exhaust gas stack of the gas turbine.

An advantage of these solutions consists in that the cooling air flow is prevented from influencing the main flow and, therefore, the combustion. Further, the usable pressure gradient of the cooling increases and a greater reduction in temperature can accordingly be achieved. The disadvantage of the solution consists in that the air can only be used partially, or not at all, for the gas turbine process.

According to one embodiment of the invention, a gas turbine with a combustor according to one, or more, or all of the embodiment forms of the invention described above in any conceivable combination is provided.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

The invention is described more fully in the following in preferred embodiment forms with reference to the accompanying drawings.

DETAILED DESCRIPTION OF THE PRESENTLY PREFERRED EMBODIMENTS

Figure 1:
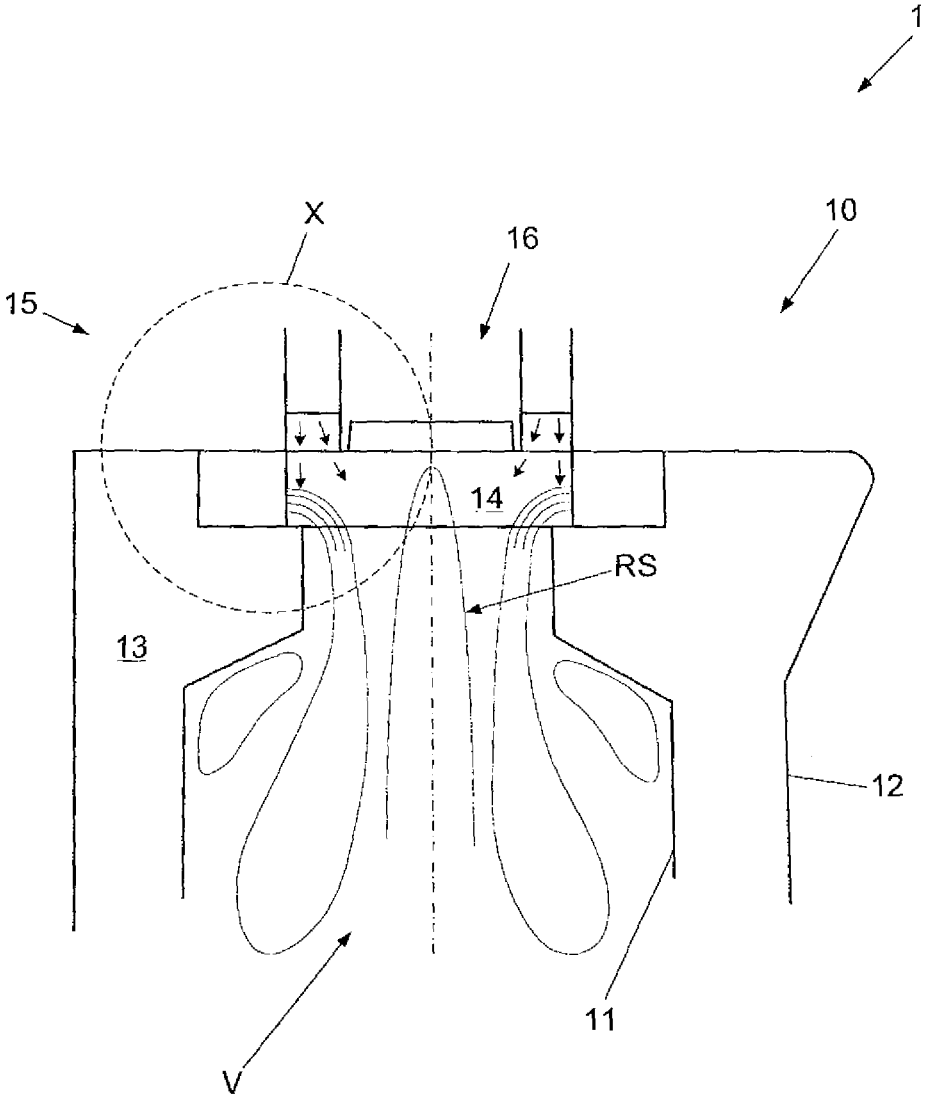
FIG. 1 is a combustor for a turbine such as a gas turbine.
Figure 2:
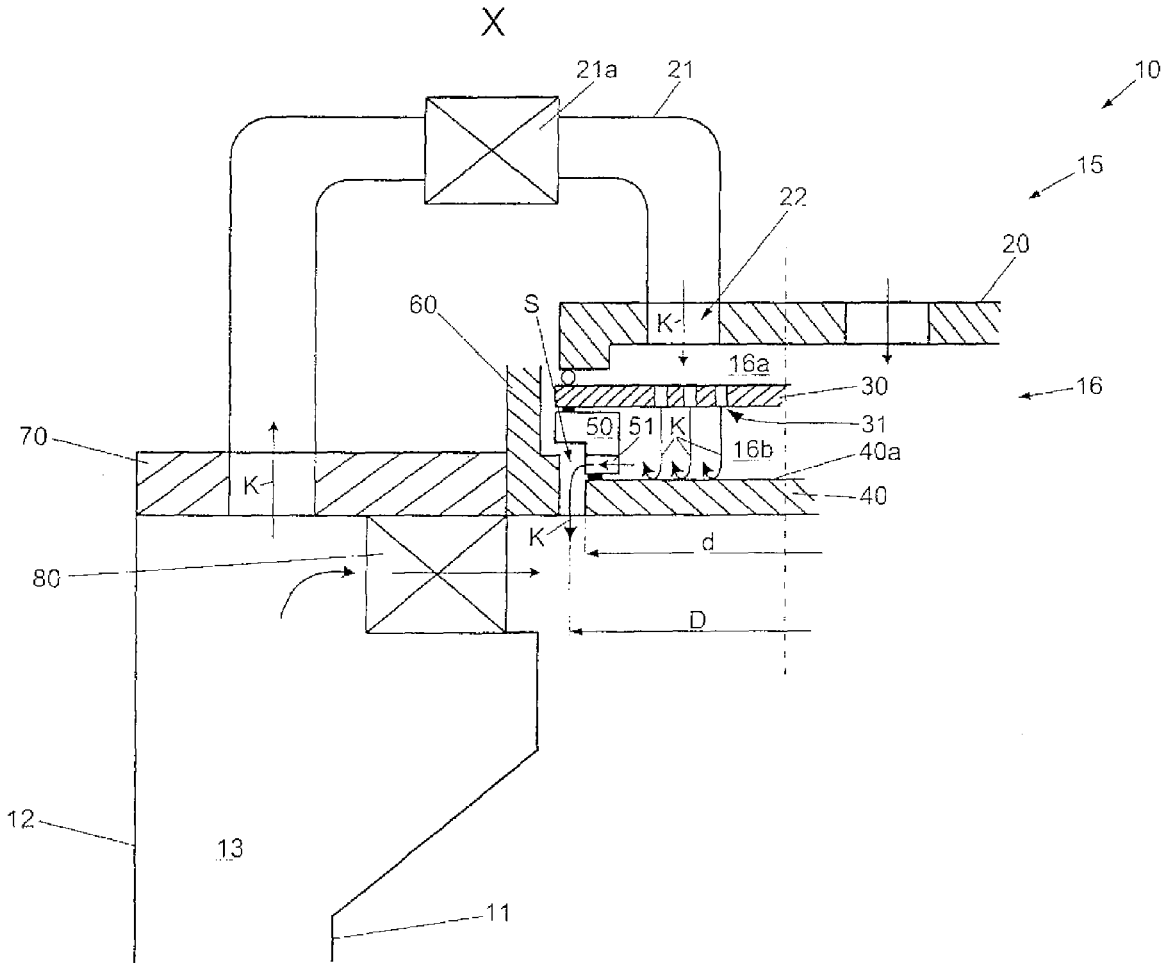
FIG. 2 is an enlarged view of an area X from FIG. 1, wherein the combustor is outfitted with internal cooling according to the invention for the combustor head plate.

As is shown in FIG. 1 and FIG. 2, a combustor 1 of a gas turbine (not shown in its entirety) according to an embodiment form of the invention has a housing 10 which in turn has a flame tube 11 in which the combustion V of an air-fuel mixture takes place and a casing 12 enclosing the flame tube 11. An air collecting chamber 13, also known as a plenum, which is defined at the front by a combustor cover 70, is formed between the flame tube 11 and the casing 12. A combustion chamber 14 which is provided for the combustion V of the air-fuel mixture is provided in the flame tube.

Further, the housing 10 has a mixing portion 15 by which the air-fuel mixture is prepared for combustion V in the combustion chamber 14. A combustion antechamber 16 is formed in the mixing portion 15.

As shown In FIG. 2, the combustor 1 has a plate-shaped central cover 20, a baffle plate 30 and a combustor head plate 40 which are arranged in the mixing portion 15 of the housing 10. More precisely, the central cover 20 forms an entrance for cooling air K which is provided for cooling the combustor head plate 40. Further, the combustor 1 has a swirl body or mixing body 80 by which the air-fuel mixture is generated for combustion V and which is arranged laterally or at the outer circumference in the combustion chamber 14.

The air collecting chamber 13 (plenum) is fluidically connected to air inlet openings 22 in the central cover 20 via feed line elements 21 (such as, e.g., pipes, in the present instance). Controller 21*a*, e.g., in the form of an air valve, is provided in the feed line elements so that the partial air mass flow flowing out of the air collecting chamber 13 through the feed line elements 21 is controllable.

Downstream of the central cover 20 considered in the flow direction of the cooling air K, the baffle plate 30 is arranged substantially parallel to the central cover 20 in the combustion antechamber 16. A first sub-chamber 16*a* of the combustion antechamber 16 is formed between the central cover 20 and the baffle plate 30 in the form of an intermediate plenum.

Downstream of the baffle plate 30 considered in the flow direction of the cooling air K, the combustor head plate 40 is arranged substantially parallel to the baffle plate 30 in the combustion antechamber 16. A second sub-chamber 16*b* of the combustion antechamber 16 is formed between the baffle plate 30 and the combustor head plate 40.

In other words, the baffle plate 30 is arranged in the combustion antechamber 16 in such a way that it divides the combustion antechamber 16 into the first sub-chamber 16*a* adjoining the feed line elements 21 fluidically connected with the air collecting chamber 13 and the second sub-chamber 16*b* adjoining the combustor head plate 40.

The combustor head plate 40 is arranged in the combustion antechamber 16 of the housing 10 in such a way that it separates the combustion antechamber 16 from the combustion chamber 14 and forms a central component part of the combustor 1.

A symmetrical removal of the partial air mass flow from the air collecting chamber 13, e.g., by a plurality of feed line elements 21, ensures that the cooling air K is removed homogeneously and also supplied homogeneously in the first sub-chamber 16*a*. The first sub-chamber 16*a* (intermediate plenum) is shaped in such a way that the cooling air K is uniformly distributed and the baffle plate 30 is supplied with cooling air K in a homogeneous manner.

The baffle plate 30 has a plurality of through-passages 31 which fluidically connect the first sub-chamber 16*a* with the second sub-chamber 16*b* so that cooling air K which has flowed into the first sub-chamber 16*a* from the air collecting chamber 13 via the feed line elements (air supply) 21 can flow into the second sub-chamber 16*b* via the through-passages 31 and can flow to a back surface 40*a* of the combustor head plate 40 facing the second sub-chamber 16*b*.

The baffle plate 30 extends substantially parallel to the combustor head plate 40 so that the cooling air K that has flowed into the second sub-chamber 16*b* impinges on a back surface 40*a* of the combustor head plate 40 substantially perpendicularly.

The second sub-chamber 16*b* is bounded on the outer circumference by an insertion part 50. A plurality of openings 51 extending substantially perpendicular to the through-passages 31 are provided in a wall of the insertion part 50. A casing part 60 defining the mixing portion 15 at the outer circumference is provided at the outer circumference of the insertion part. The casing part 60 is in turn inserted into, and held by, the combustor cover 70 of the combustor 1, which combustor cover 70 closes and delimits the air collecting chamber 13.

A gap S in the form of an annular gap is provided between the insertion part 50 and the casing part 60 and at the outer circumference of the combustor head plate 40. The second sub-chamber 16*b* is fluidically connected to the combustion chamber 14 by this gap S, so that cooling air K rebounding from the back surface 40*a* of the combustor head plate 40 can flow into the combustion chamber 14 via the gap.

More accurately, the second sub-chamber 16*b* is fluidically connected with the gap S by the openings 51 distributed along a circumference of the gap S so that cooling air K rebounding from the back surface 40*a* of the combustor head plate 40 can flow into the gap S via the openings 51.

The gap S extends parallel to the through-passages 31 and opens into the combustion chamber 14 so that a flow direction of the cooling air K through the gap S is parallel to a flow direction of the cooling air K through the through-passages 31.

As a result, after heat has been extracted from the cooling air jet of the flame holding plate 40 generated along the through-passages 31, the cooling air K is guided into the gap S and then into the combustion chamber 14 via the lateral openings 51 which are preferably constructed as bore holes.

The efficiency of the baffle cooling can be varied through the choice of perforations in the baffle plate 30 and of the pressure loss (individual pressure losses along the cooling air path). The propelling pressure gradient is substantially determined by the pressure loss in a main air mass flow (for the combustion process) through the swirl body 80.

As was already mentioned above, the thermal loading is highest at the center of the combustor head plate or combustor plate 40, and the cooling according to the invention cools the center of the combustor head plate 40 most efficiently. As the diameter increases, a cross-flow increases and the efficiency of the cooling decreases. To this extent, the proposed cooling is suited to the pronounced thermal loading of the combustor head plate 40 on the hot gas side or combustion chamber side.

It was recognized by one embodiment of the invention that the injection of the cooling air K should be carried out as externally as possible, away from the recirculating flow RS of the combustor 1, which ensures that a core zone of the recirculating flow RS is not disturbed. It was further recognized by one embodiment of the invention that it is also important to keep the momentum of the cooling air K as small as possible at the entrance to the combustion chamber 14 so as to prevent the cooling air flow from penetrating too deeply into the main flow with respect to combustion V and accordingly to influence the main flow as little as possible.

In order to satisfy these requirements, a selected diameter D (see FIG. 2) for the introduction of cooling air K into the combustion chamber 14 should be as large as possible and can preferably be expressed by the rule D (>1/2d), where d is a diameter of the combustor head plate 40. In other words, a width of the gap S should be dimensioned as large as possible, and the gap S should be arranged as far as possible on the radially outer side with respect to the combustor head plate 40. The width of the gap S defined by the casing part 60 and the insertion part 50 is preferably so dimensioned that a flow rate of the cooling air K at the outlet from the gap S into the combustion chamber 14 is less than a flow rate of the cooling air at the entrance into the gap S.

Consequently, the cooling of the combustor head plate 40 which is realized according to one embodiment of the invention based on baffle cooling which cools the combustor head plate 40, as the central component part of the combustor 1, very efficiently. By a suitable selection of the cooling air injection at the edge of the combustor head plate 40, the combustion process is not negatively influenced. Further, in accordance with the embodiment form of the invention shown in the drawings, the cooling air K is retained in the general process (an external removal of the cooling air K which will be described in the following is also possible as a variant). The pressure loss through the combustor(s) 1 of the gas turbine serves as a design criterion for the cooling.

Further, devices for optimizing cooling or the amount of cooling air, e.g., the controller 21*a*, can easily be implemented in the proposed solution.

A plurality of through-openings 42 which fluidically connect the second sub-chamber 16*b* with the combustion chamber 14 can also be provided in the combustor head plate 40 itself as an alternative to, or in addition to, the gap S and the openings 51.

In this way, the cooling air K which has flowed into the second sub-chamber 16*b* via the through-passages 31 can then be guided from the second sub-chamber 16*b* into the combustion chamber 14 directly via the combustor head plate 40.

According to a preferred variant, these through-openings 42 can each have a diameter in a range from 0.3 mm to 1.5 mm so that so that the through-openings cause the cooling air K that has flowed into the second sub-chamber 16*b* via the through-passages 31 to be effused into the combustion chamber 14 through the combustor head plate 40.

As an alternative to the through-openings, the combustor head plate 40 can be formed by a porous material so that cooling air K which has flowed into the second sub-chamber 16*b* can flow into the combustion chamber 14 via pores in the combustor head plate 40.

In each of the cases mentioned above, the cooling air K is fed again to the primary combustion process.

Alternatively, although this is also not shown in FIGS. 1 and 2, an air guiding passage can be provided in the second sub-chamber 16*b* by which the cooling air K rebounding from the back surface 40*a* of the combustor head plate 40 is fed in downstream of the combustor head plate 40 at a distance from the latter with respect to the combustion process in the combustion chamber 14.

In other words, an external cooling is used in this case, and the removal of the cooling air K is carried out in the manner described above in connection with the other embodiment forms of the invention or is carried out at another location, e.g., between a compressor outlet and the air collecting chamber 13. After cooling is carried out, the cooling air K is not injected directly into the combustion chamber 14, but rather is diverted, i.e., the cooling air K is not guided in immediately following the swirl body 80, but at a subsequent position—downstream considered in the flow direction of the hot gas of the combustion V. Possible positions for introducing the cooling air K extend from the area of a secondary zone of the combustion chamber 14 to an exhaust gas stack of the gas turbine.

The advantage of these solutions consists in that the cooling air flow is prevented from influencing the main flow and, therefore, the combustion V. Further, the usable pressure gradient of the cooling increases and a greater reduction in temperature can accordingly be achieved. The disadvantage of the solution consists in that the cooling air K can only be used partially, or not at all, for the gas turbine process.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A combustor for a gas turbine engine, comprising:

a housing having an air collecting chamber, a combustion antechamber, and a combustion chamber, the combustor chamber defined radially by a flame tube and at an upstream end by a casing part and a combustor head plate;

the combustor head plate arranged in the housing to separate the combustion antechamber from the combustion chamber;

a baffle plate arranged in the combustion antechamber substantially parallel to the combustor head plate and configured to divide the combustion antechamber into a first sub-chamber adjoining an air supply which is fluidically connected with the air collecting chamber and a second sub-chamber adjoining the combustor head plate, the baffle plate comprising a plurality of through-passages that fluidically connect the first sub-chamber with the second sub-chamber so that air that has flowed into the first sub-chamber from the air collecting chamber via the air supply flows into the second sub-chamber via the through-passages and flows to a back surface of the combustor head plate facing the second sub-chamber;

a gap arranged at an outer circumference of the combustor head plate, between the combustor head plate and the casing part, the gap fluidically connecting the second sub-chamber with the combustion chamber; and a swirl body located axially between the casing part and the flame tube and configured to inject air radially inward from the air collecting chamber and into the combustion chamber.

2. The combustor according to claim 1, wherein the baffle plate is arranged substantially parallel to the combustor head plate so that air that has flowed into the second sub-chamber impinges substantially perpendicularly on the back surface of the combustor head plate.

3. The combustor according to claim 1, further comprising:

an insertion part that defines the outer circumference of the second sub-chamber; and an opening is provided in a wall of the insertion part extending substantially perpendicular to the through-passages that fluidically connects the first sub-chamber with the second sub-chamber so that air rebounding from the back surface of the combustor head plate flows can-flew into the gap through the opening.

4. The combustor according to claim 3, wherein the gap is formed as an annular gap, and wherein a plurality of openings which extend substantially perpendicular to the through-passages so as to be distributed along a circumference of the gap are provided in the wall of the insertion part and fluidically connect the second sub-chamber with the gap so that air rebounding from the back surface of the combustor head plate flows into the gap via the openings.

5. The combustor according to claim 1, wherein the gap extends substantially parallel to the through-passages so that a flow direction of the air through the gap is parallel to a flow direction of the air through the through-passages.

6. The combustor according to claim 1, wherein a plurality of through-openings are provided in the combustor head plate that fluidically connect the second sub-chamber to the combustion chamber.

7. The combustor according to claim 6, wherein the through-openings each have a diameter in the range of 0.3 mm to 1.5 mm so that the through-openings cause the air that has flowed into the second sub-chamber via the through-passages to be effused into the combustion chamber through the combustor head plate.

8. The combustor according to claim 1, wherein the combustor head plate is formed from a porous material so that air that has flowed into the second sub-chamber flows into the combustion chamber through pores in the combustor head plate.

9. A gas turbine engine comprising:

a combustor comprising:

a housing having an air collecting chamber, a combustion antechamber, and a combustion chamber, the combustor chamber defined radially by a flame tube and at an upstream end by a casing part and a combustor head plate;

the combustor head plate arranged in the housing to separate the combustion antechamber from the combustion chamber;

a baffle plate arranged in the combustion antechamber to divide the combustion antechamber into a first sub-chamber adjoining an air supply which is fluidically connected with the air collecting chamber and a second sub-chamber adjoining the combustor head plate, the baffle plate comprising a plurality of through-passages that fluidically connect the first sub-chamber with the second sub-chamber so that air which has flowed into the first sub-chamber from the air collecting chamber via the air supply flows into the second sub-chamber via the through-passages and flows to a back surface of the combustor head plate facing the second sub-chamber;

a gap arranged at an outer circumference of the combustor head plate, between the combustor head plate and the casing part, the gap fluidically connecting the second sub-chamber with the combustion chamber; and a swirl body located axially between the casing part and the flame tube and configured to inject air radially inward from the air collecting chamber and into the combustion chamber.

* * * * *